US006144621A

United States Patent [19]

Sase

[11] Patent Number: 6,144,621

[45] Date of Patent: Nov. 7, 2000

[54] CHARGING TYPE ELECTRONIC TIMEPIECE

[75] Inventor: Masahiro Sase, Tanashi, Japan

[73] Assignee: Citizen Watch Co., Ltd., Tokyo, Japan

[21] Appl. No.: 09/116,907

[22] Filed: Jul. 17, 1998

[30] Foreign Application Priority Data

Jul. 18, 1997 [JP] Japan ..... 9-194048

[51] Int. Cl.[7] ..... G04B 1/00

[52] U.S. Cl. ..... 368/204; 368/205

[58] Field of Search ..... 368/200–205

[56] References Cited

U.S. PATENT DOCUMENTS 4,785,436 11/1988 Sase .

5,740,132 4/1998 Ohshima et al. ..... 368/204

5,978,318 11/1999 Kawaguchi et al. ..... 368/204

*Primary Examiner*—Bernard Roskoski

*Attorney, Agent, or Firm*—Kanesaka & Takeuchi

[57] ABSTRACT

A charging type electronic timepiece of the present invention is configured such that a return to a correct time display is achieved after the recovery of the voltage on the basis of time information held by a circuit in case the power-supply voltage has dropped to such an extent as to prohibit a motor drive without causing any interruption of oscillation (a stop of issue of reference signals) and such that in case the extent of the voltage drop is such as to cause an interruption of oscillation, a stop alarm display is given first after the voltage recovery through a storage of the fact of the interruption of the circuit since correct time information is no longer expected to be held by the circuit. This allows the charging type electronic timepiece to minimize the inconvenience that the user must perform a time adjustment and to securely inform the user of a true necessity of time adjustment through a display of its information. It is therefore possible to provide a charging type electronic timepiece ensuring remarkable conveniences and reliability for the user.

5 Claims, 4 Drawing Sheets

VDD
VSS
NZ R
CL
K
T
D
Q
R
A
B
C
F
G
Y
I
3
4
5
6
7
8
9
10
11
12
13
14
15
17
18
20
61
62
63
99
101
102
103
104
105
106
107
108
109
110
111
112
113
114
115
116
117
118
119
120
P4
P6
P7
P8
P9
P10
P11
P12
P13
P14
P15
P20
P51
P61
P62
P63
P81
P91
P99
P101
P102
P103
P106
P107
P108
P109
P110
P111
P112
P113
P114
P115
P116
P117
P118
P119

CHARGING TYPE ELECTRONIC TIMEPIECE

BACKGROUND OF THE INVENTION

1. Field of the Invention

The present invention relates to a charging type electronic timepiece having a voltage-varying power supply in the form of an electric storage device such as a secondary battery or a high-capacitance capacitor which is charged by a solar battery or other electric generating means.

2. Description of the Related Art

The power supply (electric storage device) of such a charging type electronic timepiece has a voltage which varies depending on the state of charging. Also, the charging action is not regularly performed, so that the timepiece might possibly come to a stop due to little or substantially no charging under poor conditions, for example, in a long-term low illuminance condition in the case of using the solar battery. Usually, as the charged quantity of electricity increases the power-supply voltage goes up. Thus, some timepieces of such a type tried as hard as possible to avoid troubles which may be caused by a stop of the timepiece, by using the electric storage device voltage (power-supply voltage) not merely for the timepiece display action but also for providing the user with information on the state of timepiece power supply and on the history of stop or information on a short of charging.

A first conventional example of such a charging type timepiece is disclosed in Japanese Patent Pub. No. Hei 7-89154(KOKOKU). This technique allows an ordinary action (1 sec. step hand driving) when the power supply has a sufficient charged quantity (power-supply voltage) but allows a first modulated hand driving action (2 sec. step hand driving) serving as a charging alarm when the charged quantity is ready to run short. Then, the arrangement is such that when the timepiece has stopped due to a short of the charged quantity, two types of alarm displays are provided by modulating the hand driving action differently from the first modulated hand driving action or by allowing a second modulated hand driving action as a stop alarm, in order to warn the user that a stop history occurred even though the hand driving has been restarted as a result of the subsequent restoration of the charged quantity and therefore that the indicated time is slow.

A second conventional example of the charging type timepiece is disclosed in Japanese Patent No. 2534484. This technique aims to achieve a power saving by stopping the hand driving in case the charged quantity has dropped to an extent which is insufficient to keep the timepiece hand driving by the step motor but is sufficient to keep the timepiece circuit action requiring a small amount of power consumption. Then, the arrangement is such that the circuit-based measurement is made of the duration by the hand driving stop so that when the hand driving has again become possible due to the subsequent recovery of the potential through recharging before reaching the potential causing a stop of oscillation, the pulse motor is rapidly forwarded in accordance with the result of the above measurement to allow the stopped hands to rapidly catch up with the correct time.

However, these prior art publication have Insufficient aspects for the improvement in spite of their respective advantages. More specifically, the first conventional example is very excellent in that it allows the timepiece to provide not only the charge alarm display but also the stop alarm display indicative of possession of a history of stop including the case of oscillation stop, but it lacks a consideration for the recovery of time after the restoration of the power-supply voltage.

The second conventional example is excellent in that it substantially released the user from cumbersome time adjusting operation through the return to the correct time of the timepiece itself, but it does not perform any return to the correct time in case the voltage has further dropped resulting in the oscillation stop. It also lacks a consideration for a positive notice to the user on the fact that the displayed time is not correct time.

OBJECTS AND SUMMARY OF THE INVENTION

It is therefore the object of the present invention to provide a charging type electronic timepiece positively combining the advantages of the above-described two conventional examples in view of their respective advantages and disadvantages, more specifically to provide a charging type timepiece having functions allowing a return to a correct time display after the recovery of the voltage in case the power-supply voltage has dropped to such an extent as to prohibit the motor drive without making the circuit inoperative, but allowing a stop alarm display after the recovery of the voltage in case the extent of the voltage drop is such as to make the circuit inoperative. This makes it possible to realize productions ensuring users' utmost conveniences.

According to the aspect of the present invention, there is provided a charging type electronic timepiece having a power supply in the form of an electric storage device which is charged by power generating means and of which power-supply voltage varies, reference signal generating means, time information generating means for generating time information, and a display device, the charging type electronic timepiece comprising stop alarm signal generating means for generating a signal indicating that a display time is incorrect, counting means for counting elapsed time during an interruption of display of the display device, first state detecting means for detecting that the power-supply voltage V of the electric storage device has dropped below an arbitrary voltage V1 at which the state of the electronic timepiece migrates from a normal use state to a short-of-charging state and further reached a voltage V2 at which a display action of the display device comes to a stop or just before comes to a stop, second state detecting means for detecting that the power-supply voltage V of the electric storage device has dropped below the voltage V2 and further reached a voltage V3 at which the reference signal generating means becomes inoperative or just before inoperative, and priority action selecting means which in case the power-supply voltage V of the electric storage device has dropped below the voltage V2, stops a display action of the display device and allows the counter means to start its counting action on the basis of time information from the time information generating means and, when display return state detecting means has detected that through the subsequent recharging the power-supply voltage has returned to an arbitrary voltage which is equal to or higher than the voltage V2, causes the display device to display a correct time based on information from the counter means to thereby provide a restoration control, the priority action selecting means giving a priority to a stop alarm display based on a signal from the stop alarm signal generating means in relation to the restoration control, in case the power-supply voltage V has dropped below the voltage V3 and when the display return state detecting means has detected that through the subsequent recharging the power-supply voltage V has returned to an arbitrary voltage which is equal to or higher than the voltage V2.

BRIEF DESCRIPTION OF THE DRAWINGS

The above and other objects, aspects, features and advantages of the present invention will become more apparent from the following detailed description with reference to the accompanying drawings, in which.

DETAILED DESCRIPTION OF THE PREFERRED EMBODIMENTS

Figure 1:
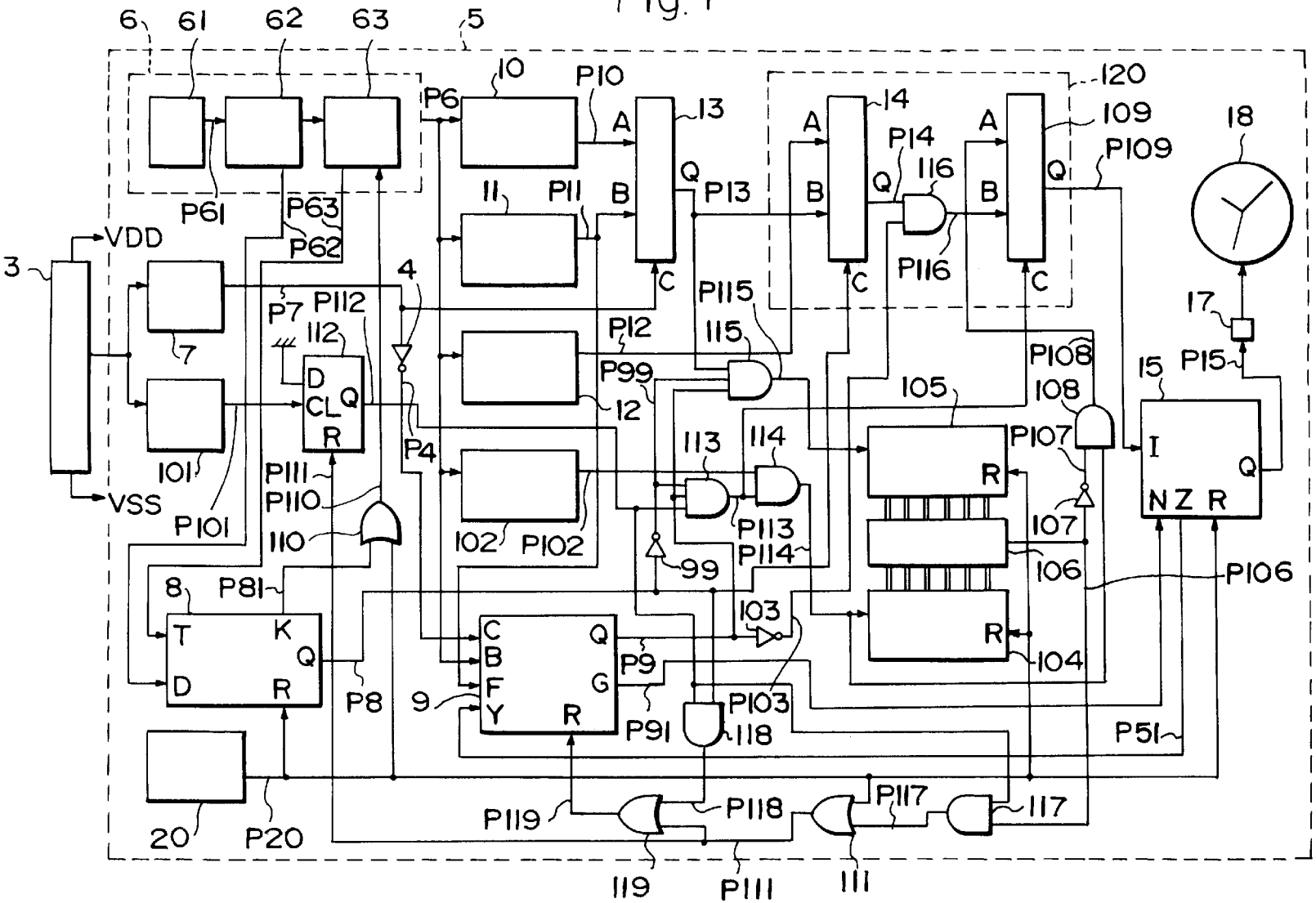
FIG. 1 is a block diagram showing by way of example an embodiment of the present invention.

Referring first to FIG. 1, an electric storage device 3 comprises a charging unit not shown which consists of power generating means such as a known solar battery for example and an overcharge prevention element such as a reverse current preventing diode or a Zener diode. In the presence of the quantity of light which is equal to or larger than a predetermined value, charging is performed to build up a voltage. The electric storage device 3 serves as a power supply for the entirety of a timepiece 5 to issue VDD and VSS.

Description will be made for major circuits within the interior of the timepiece 5 and actions thereof.

A reference signal generating circuit 6 provides as its output a group of reference signals P6 (including a plurality of pulses with different cycles obtained from a time reference). A 1 sec. signal generating circuit 10 issues at all times a 1 sec. step pulse P10 (accurate time information signal) in the form of an ordinary hand driving signal. This output is fed to an input terminal A of a first selecting circuit 13 serving as a selector. The selector is a control circuit allowing, for the output to its terminal Q, a selection of an input A when an input to its terminal C is "High(H)" level, or a selection of an input B when the input to the terminal C is "Low(L)" level.

On the basis of an arbitrary reference signal P6, a charge alarm signal generating circuit 11 creates for output a 2 sec. step pulse P11 allowing a 2 sec. step drive, for example, an accurate time information signal allowing a generation of a pair of 40 ms interval drive pulses every two seconds. The 2 sec. step pulse P11 is a charge alarm signal urging the user to an action for charging the timepiece, for example, a signal causing an emission of light in case the timepiece has a solar battery as charging means or a signal causing a vibration in case of a self-winding generating type timepiece. The charge alarm signal (2 sec. step pulse) P11 is fed to an input terminal B of the first selecting circuit 13.

An output signal P13 from the terminal Q of the first selecting circuit 13 is either the 1 sec. signal P10 or the charge alarm signal P11. The output signal P13 is fed via an input terminal B of a second selecting circuit 14 serving as a selector and through an AND gate 115 to a count input terminal of an elapsed time counter 105 which will be described later. In this embodiment, time information generating means are formed from the charge alarm signal generating circuit 11 issuing an accurate time information signal and the 1 sec. signal generating circuit 10.

On the basis of a predetermined reference signal P6, a stop alarm signal generating circuit 12 creates for output a stop alarm signal for informing the user that the timepiece has come to a stop, that is, an irregular 2 sec. step pulse P12 which has unconstantly been modulated differently from the 2 sec. step drive. More specifically, it issues for example a 40 ms interval drive pulse and a 250 ms interval drive pulse every two seconds in an alternate manner. In this case, however, no accurate time information signal is obtained because of the occurrence of a stop of the timepiece. The irregular 2 sec. step pulse P12 is fed to an input terminal A of the second selecting circuit 14.

It is to be noted that the input terminal B of the second selecting circuit 14 receives an output signal P13 from a terminal Q of the first selecting circuit 13. An output signal P14 output from a terminal Q of the second selecting circuit 14 is fed via an AND gate 116 to an input terminal B of a third selecting circuit 109 serving as a selector.

On the basis of a predetermined reference signal P6, a rapid forwarding signal generating circuit 102 issues a 64 Hz rapid forwarding step pulse P102 for allowing hands to be driven at a speed 64 times the ordinary speed to thereby provide a rapid recovery from a slow indicated time. The rapid forwarding step pulse P102 is fed via an AND gate 114 to a count input terminal of a drive pulse counter 104. The pulse P102 is further fed via the AND gate 108 to an input terminal A of the third selecting circuit 109 serving as the selector.

An output signal P109 from a terminal Q of the third selecting circuit 109 is eventually an output selected from a group consisting of the 1 sec. signal P10, the 2 sec. step pulse P11 which is the charge alarm signal, the irregular 2 sec. step pulse P12 which is the stop alarm signal, and the rapid forwarding step pulse P102. It is finally fed as a drive pulse signal P109 to an input terminal I of a motor driving circuit 15.

It is to be appreciated that the second selecting circuit 14, the AND gate 116 and the third selecting circuit 109 constitute a priority action selecting circuit 120 serving as priority action selecting means which makes a decision that a priority is given to a stop alarm display after the restoration of the voltage by recharging in case of occurrence of a voltage drop resulting in an interruption of the reference signal.

The motor driving circuit 15 converts the drive signal input to the terminal I into a bipolar drive pulse P15 suitable for a bipolar pulse motor and provides it as an output from its terminal Q. The motor driving circuit 15 is provided with other terminals, that is, a reset input terminal R for fixing the action, an input terminal N for receiving a strobe signal providing a timing to detect an induction voltage which may be caused in a motor coil by a motion of a rotor, and a terminal Z for the output of the detected induction voltage. The motor driving circuit 15 also performs functional actions associated with them. Such a configuration is already a known technique since it is substantially the same as a conventional timepiece configuration provided with a continuous power saving function (so-called load compensation function) by which the motor is usually driven with a minimum energy but the drive energy is increased for redriving upon the detection of a stop.

A pulse motor 17 is a known one having a bipolar permanent magnet rotor. A hand driving display 18 is also known which is in the form of a train wheel with an indicator driven by the pulse motor 17.

A manual switching circuit 20 changes the state through the protrusion and retraction of a crown not shown and issues the reset signal P20 having the "High" level when the crown is protruded. The reset signal P20 is fed to respective reset terminals R of a reference signal stop storing circuit 8, the elapsed time counter 105, the drive pulse counter 104 and the motor driving circuit 15. The reset signal P20 is further fed via an OR gate 110 to a reset terminal R of a second frequency dividing circuit 63 which will be described later. The reset signal P20 is further fed via an OR gate 111 to a reset terminal R of a data flip-flop (hereinafter, referred to as a D-FF) 112 and fed via the OR gate 111 and an OR gate 119 to a reset terminal R of a pulse motor stop storing circuit 9.

Once the reset signal P20 is input to the reset terminals of the respective circuits, these circuits are returned to their initial logic states, so that the counter circuits are reset to zero and that the storage of the reference signal stop and the motor stop is erased. Then the display is manually corrected with the power-supply voltage of the electric storage device 3 being in the normal state. After that the crown is retracted to release the constraint of the reset circuits at one time, allowing the timepiece action to start from its initial state.

A V1 detecting circuit 7 serving as short-of-charging state detecting means issues the V1 detection signal P7 having the "High" level when the power-supply voltage of the electric storage device 3 is higher than a voltage V1 requiring the charging or issues the V1 detection signal P7 having "Low Level" when it becomes lower than the voltage V1. The V1 detection signal P7 is fed to a terminal C of the first selecting circuit 13 so that when the signal is the "High" level, the first selecting circuit 13 selects the ordinary 1 sec. step pulse P10 input to the terminal A. However, once the V1 detection signal P7 goes to the "Low Level" as a result of a voltage drop, the first selecting circuit 13 provides selectively as its output from the terminal Q the 2 sec. step pulse P11 input to the terminal B in place of the 1 sec. step pulse P10 input to the terminal A.

A V4 detection circuit 101 acts as display return state detection means and provides as its output the V4 detection signal P101 having the "High" level when the voltage (power-supply voltage) V of the electric storage device 3 is higher than a hand driving return voltage V4 or the V4 detection signal P101 having the "Low Level" when it is lower.

In this embodiment, the hand driving return voltage V4 is so set that the power-supply voltage V is fairly lower than the voltage V1 but slightly higher than an upper limit voltage V2 at which the pulse motor 17 comes to a stop (undrivable). The V4 detection signal P101 is fed to a terminal CL of the D-FF 112.

At the timing of rise of the signal input to the terminal CL, the D-FF 112 reads a VDD potential applied constantly to its terminal D to impart the "High" level signal to its terminal Q. However, as described above, the power-supply voltage V already exceeds the hand driving return voltage V4 in the state where the resetting effected by the manual switching circuit 20 has been canceled, so that an output signal P112 from the terminal Q of the D-FF 112 is initially low and remains unchanged afterward. The signal P112 output from the terminal Q goes to the "High" level only when the power-supply voltage V is built up by recharging to again exceed the V4 after the power-supply voltage V has dropped from V2 or V3 and resulted in V<V4.

The output signal P112 from the terminal Q is one of inputs to 3-input AND gate 113. An output signal P113 from the AND gate 113 opens or closes the AND gate 114 to control a pass of the rapid forwarding pulse P102 and is fed to a terminal C of the third selecting circuit 109. The signal P112 from the terminal Q is fed to an AND gate 117 as well, an output P117 of which is fed via an OR gate 111 and as a signal Pill to the reset terminal R of the D-FF 112. The signal P112 from the terminal Q is fed to an AND gate 118 as well, an output signal P118 of which is fed via an OR gate 119 and as a signal P119 to the reset terminal R of the pulse motor stop storing circuit 9.

Using a 512 Hz output signal P62 from a first frequency dividing circuit 62 of the reference signal generating circuit 6 and a ½ Hz output signal P63 from the second frequency dividing circuit 63, the reference signal stop storing circuit 8 serving as the second state detecting means supervises an oscillating action of a time reference 61 of the reference signal generating circuit 6. Then, once a stop of the oscillation is detected, the reference signal stop storing circuit 8 provides a stop detection signal P81 as an output from its terminal K to reset the second frequency dividing circuit 63 by way of the OR gate 110.

The reference signal stop storing circuit 8 stores the stop of the oscillation, and when the power-supply voltage is restored thereafter to resume the oscillation, it issues the reference signal stop storage signal P8 having the "High" level. The signal P8 is fed to a terminal C of the second selecting circuit 14, allowing the second selecting circuit 14 to select as a signal P14 the irregular 2 sec. step pulse P12 which is the stop alarm signal. The signal P8 is inverted by an inverter 99 into a signal P99. The inverted signal P99 is fed to the AND gates 113 and 115. When the signal P8 is the "High" level (the state where an oscillation stop has occurred), the signal 99 goes to the "Low Level", serving to close these gates. Note that the details of the reference signal stop storing circuit 8 will be described later with reference to FIG. 2.

The pulse motor stop storing circuit 9 acting as first state detecting means interchanges signals with the motor driving circuit 15 to supervise the detection of whether the pulse motor 17 has normally operated. A terminal C of the pulse motor stop storing circuit 9 receives a signal P4 which is obtained by inverting the output signal P7 from the V1 detecting circuit 7 by using an inverter, permitting the functions of the detection and storage of whether the pulse motor has normally operated to work when the output signal P7 from the V1 detection circuit 7 is low (the signal P4 is the "High" level), which represents the state where the power-supply voltage is lower than the voltage V1. On the contrary, the pulse motor stop storing circuit 9 prohibits its circuit action of detection and storage of whether the pulse motor 17 has normally operated when the output signal P7 from the V1 detection circuit 7 is the "High" level (the signal P4 is the "Low" level).

On the other hand, immediately after the motor driving circuit 15 has received the drive pulse signal P109, the pulse motor stop storing circuit 9 observes a variation with time of the induction voltage which may be generated in the coil by a vibration remaining in the rotor, to thereby judge whether the pulse motor 17 has normally rotated or not. On the basis of the reference signal P6 to its terminal B, the pulse motor stop storing circuit 9 creates some strobe signals P91 for sampling the induction voltage at a predetermined timing and provides them from its terminal G to a terminal N of the motor driving circuit 15. The motor driving circuit 15 provides induction voltage values at respective moments in the form of a series of induction voltage signals P51 from its terminal Z back to a terminal Y of the pulse motor stop storing circuit 9. When non-rotation of the rotor is detected and judged from the induction voltage signals P51 and from the 2 sec. step pulse P11 from the charge alarm signal generating circuit 11, the pulse motor stop storing circuit 9 stores that fact and issues from its terminal Q the pulse motor stop storage signal P9 having the "High" level.

This pulse motor stop storage signal P9 is fed intactly to the AND gates 113 and 115, while simultaneously it is inverted by an inverter 103 into a signal P103, which in turn is fed to the AND gate 116. The AND gate 116 prevents the output signal P14 from the terminal Q of the second selecting circuit 14 from being fed to the input terminal B of the third selecting circuit 109 when the pulse motor stop storing circuit 9 stores a stop of the pulse motor and the signal P9 goes to the "High" level, in other words, the signal P103 goes to the "Low" level .The details of the pulse motor stop storing circuit 9 will be described later with reference to FIG. 3.

Description will then be made for a circuit action performed by a return of the power-supply voltage V of the electric storage device 3 to its normal value after the reproduction of a correct time through the rapid forwarding of the display, in case the power-supply voltage V has dropped resulting in a charge alarm state, that is, in case as a result of a drop of the power-supply voltage V below the upper limit voltage V2 at which the pulse motor comes to a stop, the pulse motor has stopped without occurrence of stop of the reference signals and thereafter the power-supply voltage has returned to V4.

When the power-supply voltage has merely become lower than the voltage V2, the output signal P8 from the terminal Q of the reference signal stop storing circuit 8 remains the "Low" level (its inverted signal P99 is the "High" level), although when the power-supply voltage has further dropped with a stop of the pulse motor, the output P9 from the terminal Q of the pulse motor stop storing circuit 9 goes to the "High" level. This immediately allows two inputs of the 3-input AND gate 115 to go to the "High" level, permitting a pass of the other input signal P13 in the form of the signal P115.

It is to be appreciated that the power-supply voltage lower than the voltage V2 is naturally lower than the voltage V1, so that the signal P13 output from the first selecting circuit 13 is the 2 sec. step pulse P11 which has been selected upon a drop of the power-supply voltage. The signal P115 results in a count input to the elapsed time counter 105 acting as the counter means. Accordingly, immediately after the stop of the pulse motor 17, the counter 105 starts the count of the elapsed time by use of the 2 sec. step pulse P11 which is the charge alarm signal. The full count value of the elapsed time counter 105 is equal to the rotation cycle of the entire hands, for example it is 43200 in the 1 sec. /12 hrs. drive pulse number. The counter 105 repeats the count when its count value reaches the full count.

If in this state power-supply voltage is gradually restored and reaches the hand driving return voltage V4 with the result that the output P112 from the terminal Q of the D-FF 112 goes to the "High" level from the "Low" level as described above, all the three inputs of the signals P112, P99 and P9 become to the "High" level, allowing the output P113 from the AND gate 113 to go to the "High" level. As a result of this, the AND gate 114 opens to allow a pass of the rapid forwarding signal P102 in the form of an output signal P114. The signal P114 is a count input to the drive pulse counter 104 and simultaneously is one input to the AND gate 108. Note that the full count value of the drive pulse counter 104 is equal to that of the elapsed time counter 105.

The drive pulse counter 104 executes a rapid counting at a rate of 64 Hz, pursuing the elapsed time counter 105 which has started its count the instant that the power-supply voltage comes below the voltage V2.

An identity detecting circuit 106 is provided for comparing count values of the two counters to issue an output signal P106 which goes to the "Low" level when the two count values are not identical to each other or goes to the "High" level when they are identical to each other. The elapsed time counter 105 and the drive pulse counter 104 are reset in their respective initial states to zero in count values, so that the output signal P106 from the identity detecting circuit 106 is the "High" level. While the elapsed time counter 105 executes its counting, the two count values are not identical to each other resulting in the signal P106 having the "Low" level. The instant the count value of the drive pulse counter 104 catches up with that of the elapsed time counter 105, the signal P106 is again allowed to go to the "High" level.

The signal P106 is inverted by an inverter 107 into a signal P107, which in turn results in one input to the AND gate 108. Accordingly, only for the duration in which the count values of the two counters 104 and 105 are not identical to each other, the AND gate 108 opens allowing the rapid forwarding signal P114 to be imparted to the input terminal A of the third selecting circuit 109. Since input to the terminal C of the third selecting circuit 109 is the output signal P113 from the AND gate 113 which is the "High" level, the input to the terminal A is selected. In consequence, the drive pulse signal P109 from the output terminal Q of the third selecting circuit 109 is a rapid forwarding signal P108, which in turn is input to the terminal I of the motor driving circuit 15 for the conversion into a corresponding drive signal P15, whereby the pulse motor 17 performs a catch-up action by rapid forwarding up to a correct current time from its stopped state.

It is to be appreciated that strictly speaking, followed up by the rapid forwarding signal in this embodiment is not ordinarily a 1 sec. hand driving signal but a 2 sec. step pulse so that there is provided a correct current time in the 2 sec. hand driving display.

When the count value of the drive pulse counter 104 catches up with the count value of the elapsed time counter 105, the output signal P106 from the identity detecting circuit 106 goes to the "High" level, closing the AND gate 108 to interrupt a supply of the rapid forwarding pulse P108 to the input terminal A of the third selecting circuit 109. On the other hand, when the AND gate 117 receives this signal P106 and the signal P112 which is the "High" level as a result of arrival of the power-supply voltage at the volt V4, the output P117 from the AND gate 117 goes to the "High" level.

It is to be appreciated herein that even though the output signal P101 from the V4 detecting circuit 101 has returned to the "Low" level because of a slight voltage drop which is attributable to the rapid forwarding, the signal P112 remains the "High" level by virtue of a latching action of the D-FF 112. The output P117 having the "High" level from the AND gate 117 acts via the OR gate 111 on the reset terminal R of the D-FF 112 and acts via the OR gate 111 and the OR gate 119 on the reset terminal R of the pulse motor stop storing circuit 9 to thereby reset these circuits.

The signal P112 which has turned the "Low" level through the resetting of the D-FF 112 allows the output signal P113 from the AND gate 113 to go to the "Low" level. As a result of this, the AND gate 114 is closed to block a pass of the rapid forwarding pulse 102 to the drive pulse counter 104 and to the AND gate 108. On the other hand, the output signal 113 having the "Low" level acts on the terminal C of the third selecting circuit 109, allowing a selection of the input to the terminal B of the circuit 109. At that time, the terminal B of the third selecting circuit 109 receives is the output signal P14 from the second selecting circuit 14 which has passed through the AND gate 116 which has opened by an inverted output P103 of the signal P9 which has turned to the "Low" level as a result of resetting of the pulse motor stop storing circuit 9. In consequence, the third selecting circuit 109 selectively provides the output signal P14 as its output P109.

Accordingly, selectively output as the drive pulse signal P109 is either the 2 sec. step pulse P11 which is the charge alarm signal selected by the first selecting circuit 13 when the power-supply voltage is lower than the voltage V1 or the 1 sec. step pulse P10 which is the ordinary 1 sec. hand driving signal selected by the first selecting circuit 13 when the power-supply voltage is larger than the voltage V1 as a result of a certain amount of charge. Then, the drive pulse signal P109 in the form of the output signal from the terminal Q of the third selecting circuit 109 is applied to the motor driving circuit 15 so that the pulse motor 17 is driven to allow the hand driving display 18 to perform a predetermined hand driving for a correct current time display.

Description will then be made for a circuit action in case of continuing the stop alarm display, even though the power supply voltage has exceeded the voltage V1 as a result of recovery by charge, without performing the restoration of the current time by the rapid forwarding since it is not feasible in case the power-supply voltage of the electric storage device 3 has dropped to a large extent and becomes lower than the voltage V3 at which the oscillation of the reference signal generating circuit 6 comes to a stop, with the stop of the oscillation of the time reference 61, and thereafter the power-supply voltage has been recovered up to the voltage V4.

The instant that a stop of the oscillation of the time reference 61 occurs due to a large drop in the power-supply voltage, the reference signal stop storing circuit 8 issues the signal P81 through its terminal K to reset the second frequency dividing circuit 63. Then, almost all of the circuits are put into the stopped state due to a stop of the clock signals, substantially eliminating the power consumption. Afterward, when the power-supply voltage is boosted above the voltage V3 by the recharge, the oscillation of the time reference 61 resumes, allowing a recovery of the circuit action. At that time, the output P8 from the terminal Q of the reference signal stop storing circuit 8 being the "High" level, the inverted signal P99 thereof by the inverter 99 causes the output P113 from the AND gate 113 to go to the "Low" level to block a pass of the rapid forwarding pulse P102 through the AND gate 114. The inverted signal P99 further closes the AND gate 115 to block the input P115 to the elapsed time counter 105, thereby interrupting the counting action of the elapsed time counter 105. Therefore, the elapsed time counter 105 interrupts its counting action which has already been started with a rise of the power-supply voltage (V3<V<V2).

The drive pulse counter 104 performs no counting action due to no count inputs and performs no rapid forwarding display either since the control of the AND gate 113 prevents the AND gate 114 from providing the 64 Hz rapid forwarding signal in the form of the output signal P114. In this state, the identity detecting circuit 106 judges non-identity providing the output P106 having the "Low" level. The signal P8 having the "High" level from the reference signal stop storing circuit 8 is fed to the terminal C of the second selecting circuit 14. This allows the second selecting circuit 14 to select the irregular 2 sec. step signal P12 which is the stop alarm signal input to the terminal A, to issue it in the form of the signal P14 from the terminal Q.

However, the AND gate 116 remains closed due to the signal P9 having the "High" level in the pulse motor stop storage state and hence to the "Low" level inverted signal P103, so that even though the third selecting circuit 109 selects a signal P116 input to the terminal B in response to the low-level terminal C, the output P109 from the terminal Q remains the "Low" level, providing no drive to the motor driving circuit 15.

However, when the power-supply voltage V is increased to reach the voltage V4, the output P101 from the V4 detecting circuit 101 first turns to "High" level so that the D-FF 112 reads the change to turn the signal P112 to be the "High" level. This allows the AND gate 118 having two inputs in the form of the signal P112 and the signal P8 which is "High" level due to the reference signal stop storage to issue the output P118 having the "High" level, which in turn results via the OR gate 119 in the signal P119 for resetting the pulse motor stop storing circuit 9.

In response to this, the pulse motor stop storing circuit 9 issues from its terminal Q the output P9 having the "Low" level, the inverted signal P103 of which goes to the "High" level to open the AND gate 116. The AND gate 116 permits the signal P12 (irregular 2 sec. step pulse which is the stop alarm signal) input to the terminal A through the selection by the second selecting circuit 14 to pass therethrough in the form of the output P116.

Since the signal P113 input to the terminal C is the "Low" level in this state, the third selecting circuit 109 provides as its selective output the input to the terminal B. Accordingly, the third selecting circuit 109 issues the signal P116, that is, the irregular 2 sec. step pulse P12 as the drive pulse signal P109 which is the drive input signal (input to the terminal I) to the motor driving circuit 15, to thereby provide an irregular 2 sec. step hand driving display. This stop alarm display state remains unchanged irrespective of the recharge until the power-supply voltage V is further raised to exceed the voltage V1. Then, the irregular 2 sec. step hand driving in the stop alarm display state is canceled by resetting the reference signal stop storing circuit 8 by the signal P20 from the manual switching circuit 20 to thereby turn the reference signal stop storage signal P8 to be the "Low" level. In other words, the cancellation is achieved by pulling the crown acting as the manual switch to perform a time setting operation.

Description will then be made for an internal configuration of the reference signal stop storing circuit 8 and the pulse motor stop storing circuit 9.

Figure 2:
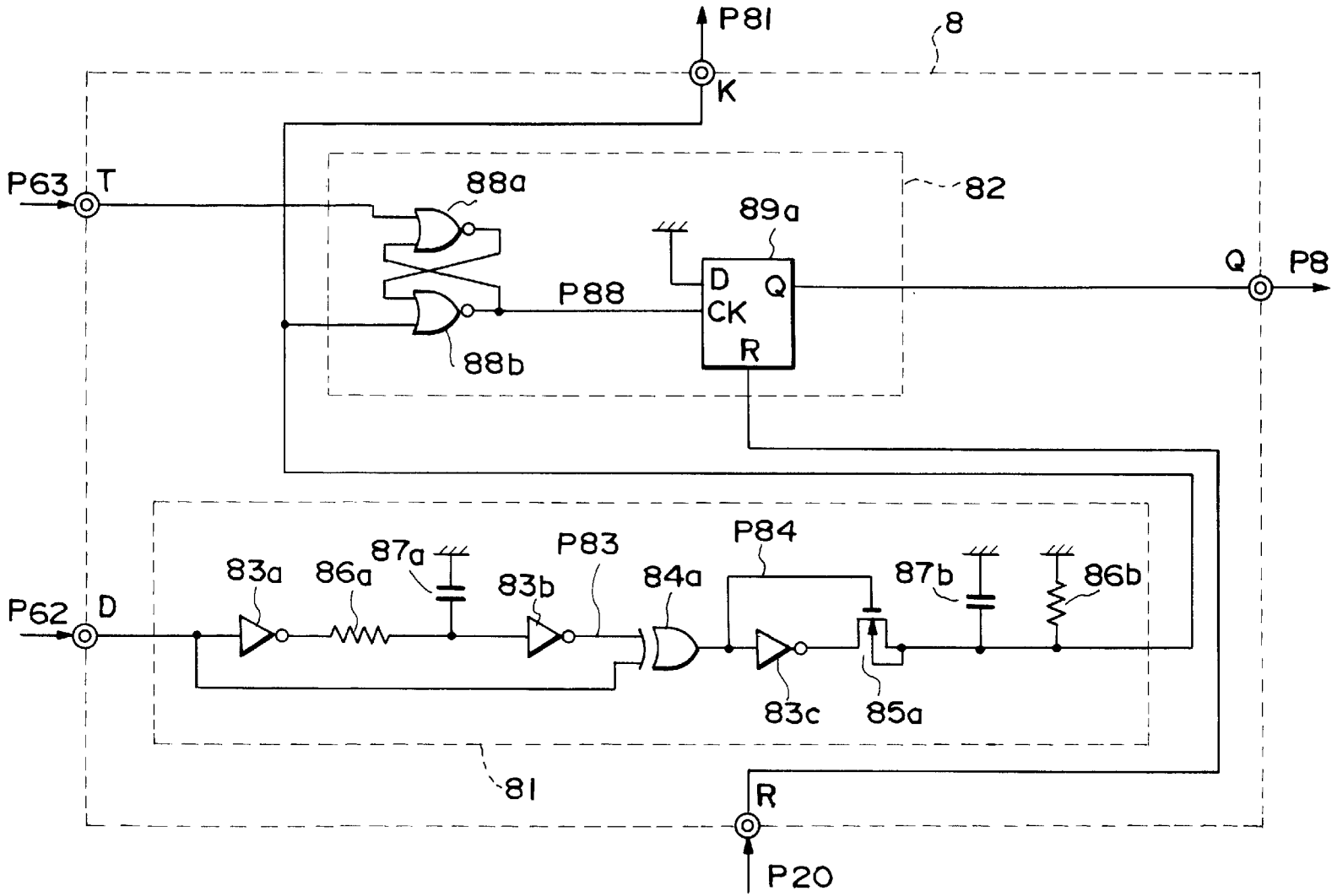
FIG. 2 is a detailed view of a reference signal stop storing circuit in accordance with the embodiment.

Reference is made first to FIG. 2 which illustrates a detailed configuration of the reference signal stop storing circuit 8.

The reference signal stop storing circuit 8 comprises a stop detecting unit 81 which issues a stop detection signal P81 and a storing unit 82 which issues a reference stop storage signal P8.

The stop detecting unit 81 includes inverters 83*a*, 83*b* and 83*c* (hereinafter, referred to as INVs 83*a*, 83*b* and 83*c*, respectively), an exclusive OR gate 84*a* (hereinafter, referred to as an EXOR 84*a*) , an n-channel MOS transistor 85*a* (hereinafter, referred to as a CMOSTR 85*a*) , capacitors 87*a* and 87*b* and resistors 86*a* and 86*b*. The INV 83*a* has an input terminal connected to the above-described input terminal D so as to receive the reference signal P62 from the first frequency diving circuit 62. An output terminal of the INV 83*a* is connected to an input terminal of the INV 83*b* by way of an integration circuit consisting of the resistor 86*a* and the capacitor 87*a*. As a result of this, one terminal of the EXOR 84*a* receives from an output terminal of the INV 83*b* a delay signal P83 having a delay which is equal to a delay time of the integration circuit relative to the reference action signal P62, and the other terminal thereof receives the reference action signal P62 from the terminal D.

This allows the EXOR 84*a* to issue from its output terminal a pulse signal P84 having a narrow width which is equal to a time difference between the two input signals. The output signal P84 is fed both to a gate of the CMOSTR 85*a* and via the INV 83*c* to a source of the CMOSTR 85*a*. The bulk of the CMOSTR 85*a* is coincident with a drain output, which issues the stop detection signal P81 by way of a charge pump circuit consisting of the capacitor 87*b* and the resistor 86*b*. This stop detection signal P81 is issued from the output terminal K of the reference signal stop storing circuit 8.

The storing unit 82 includes 2-input inverted NOR gates 88*a* and 88*b* (hereinafter, referred to as NORs 88*a* and 88*b*, respectively) and data flip-flop 89*a* (hereinafter, referred to as a D-FF 89*a*). The NORs 88*a* and 88*b* make up a latch circuit. One input terminal of the NOR 88*a* is a set input of the latch circuit and is connected to the input terminal T to receive a storage timing signal P63 from the second frequency dividing circuit 63.

One input terminal of the NOR 88*b* on the other hand is a reset input of the latch circuit and receives the stop detection signal P81 from the stop detecting unit 81. The NOR 88*b* has an output terminal serving as an output of the latch circuit, through which a latch signal P88 is issued. The D-FF 89*a* has an input terminal R connected to the input terminal R of the reference signal stop storing circuit 8 so that in response to an input of the reset signal P20 from the manual switching circuit 20 the D-FF 89*a* provides the output having the "Low" level from its output terminal Q. The D-FF 89*a* has another input terminal CK for receiving the latch signal P88 from the NOR 88*b*. The D-FF 89*a* has a further input terminal D which is connected to a power-supply terminal VDD and is kept the "High" level at all times. The D-FF 89*a* reads data (which are always "High" level in this case) from the input terminal D in response to a rise of the signal to the input terminal CK and delivers the reference stop storage signal P8 having the "High" level to its output terminal Q. This reference stop storage signal P8 is fed to the output terminal Q of the reference signal stop storing circuit 8.

Figure 3:
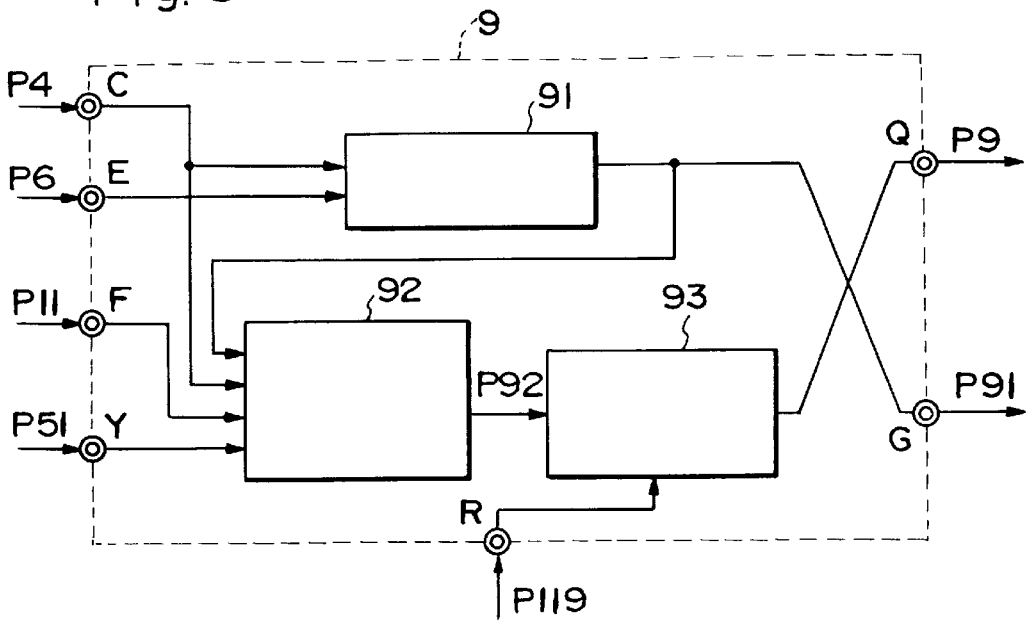
FIG. 3 is a detailed view of a pulse motor stop storing circuit in accordance with the embodiment.

Reference is then made to FIG. 3 to explain the details of the pulse motor stop storing circuit 9.

This pulse motor stop storing circuit 9 comprises a strobe signal creating unit 91, a pulse motor stop detecting unit 92 and a pulse motor stop storing unit 93.

Through the terminal C of the pulse motor stop storing circuit 9, the strobe signal creating unit 91 and the pulse motor stop detecting unit 92 receive the signal P4 which is obtained by inverting the output signal P7 from the V1 detecting circuit 7 by using the INV 4. On the basis of the reference signal P6, the strobe signal creating unit 91 creates the strobe signal P91 for sampling at a predetermined timing an induction voltage which may occur in the coil of the pulse motor 17, to impart it to the output terminal G of the pulse motor stop storing circuit 9.

In order to issue a pulse motor stop detection signal P92, the pulse motor stop detecting unit 92 judges whether rotations of the motor have occurred or not, based on the strobe signal creating unit 91, the 2 sec. step pulse P11 fed via an input terminal F, and the induction voltage signal P51 fed via the input terminal Y from the motor driving circuit 15.

The pulse motor stop storing unit 93 receives this signal P92 to store a non-rotation, namely, a stop of the motor to impart the pulse motor stop storage signal P9 having the "High" level to the output terminal Q of the pulse motor stop storing circuit 9. Through the input terminal R of the circuit 9, the pulse motor stop storing unit 93 receives as the signal P119 the reset signal P20 fed via the OR gates 111 and 119 from the manual switching circuit 20, so that when the crown is protruded, the pulse motor stop storage signal P9 is reset from the "High" level to the "Low" level.

Figure 4:
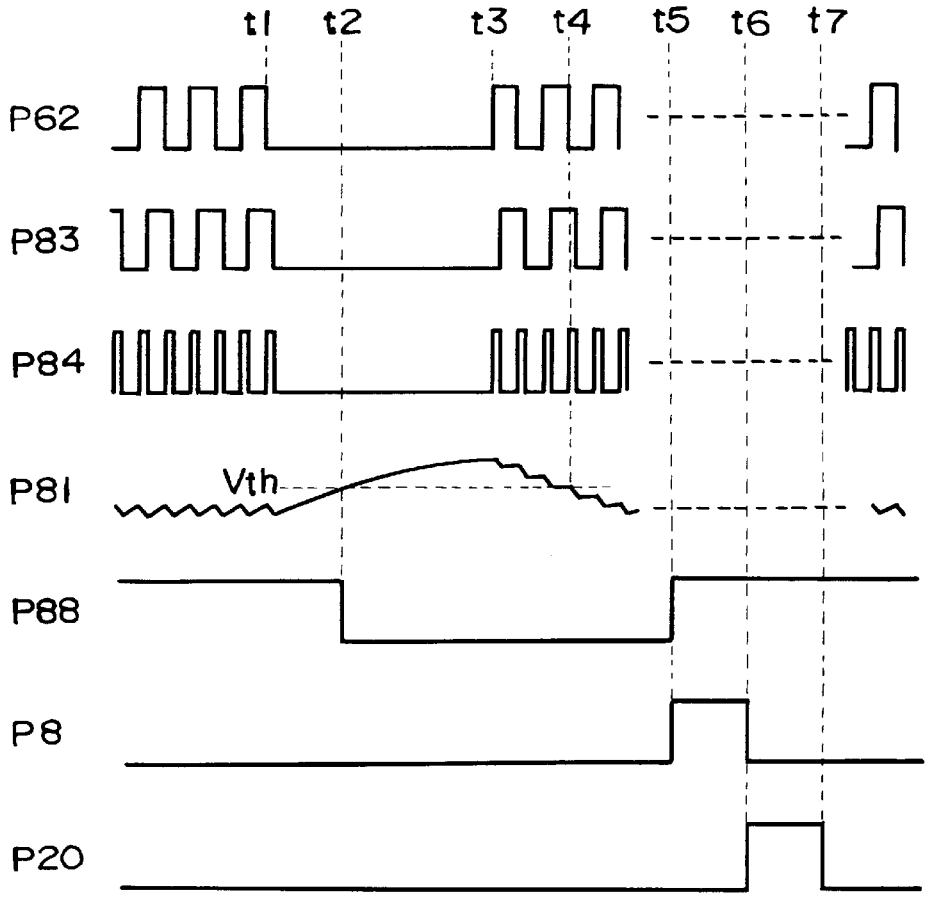
FIG. 4 illustrates voltage waveforms of signals appearing on elements of the reference signal stop storing circuit in accordance with the embodiment.

Taking the timing into consideration, the action of the reference signal stop storing circuit 8 will again be described with reference to a voltage waveform diagram of FIG. 4.

In the diagram, t1 to t7 denote timings. Up to the timing tl, the reference signal generating circuit 6 performs a regular action to issue a 512 Hz reference action signal P62.

For the period from t1 to t3, the reference signal generating circuit 6 is inactive due to some cause, e.g., a significant drop of the voltage at the electric storage device 3, with the result that the reference action signal P62 is also interrupted. After t3, the recovery of the voltage allows a restart of the action of the reference signal generating circuit 6 to resume the reference action signal P62.

The period up to the timing t1 is first described. The stop detecting unit 81 creates an upward pulse signal P84 with a small width from a time difference between the reference action signal P62 and its delay signal P83 of FIG. 2. For this reason, the capacitor 87*b* remains charged allowing the stop detection signal P81 to be kept at low level, which indicates that the reference signal generating circuit 6 is in normal operation.

The period from the timings t1 to t3 is then described. As described above, the reference signal generating circuit 6 becomes inactive at the timing t1 to cause an interruption of its reference action signal P62 at t1, although its delay signal P83 also comes to a stop at the same timing so that the narrow pulse signal P84 is fixed to low. This prevents a new charge into the capacitor 87*b* under the control of the INV 83*c* and the CMOSTR 85*a*, allowing the accumulated electric charges to be discharged through the resistor 86*b*. As a result of this, the level of the stop detection signal P81 rises and exceeds the logical Vth.

This timing t2 is a timing at which a stop of the reference signal generating circuit 6 is detected, and at which timing the latch signal P88 goes from the "High" level to the "Low" level. The stop detection signal P81 resulting in the "High" level at t2 resets a frequency dividing stage of the second frequency dividing circuit 63 to count zero. Naturally, the frequency dividing action of the second frequency dividing circuit 63 remains interrupted.

The period after the timing t3 is then described.

When the recovery of the voltage brings about a reappearance of the reference action signal P62 from the reference signal generating circuit 6, the delay signal P83 and the narrow pulse signal P84 also appear, allowing a restart of charge into the capacitor 86*b* under the control of the CMOSTR 85*a*. As a result of this, the potential of the stop detection signal P81 gradually drops and then at the timing t4 goes below the logical Vth, turning the "Low" level. Detection is thus made of a restart of the regular action of the reference signal generating circuit 6. Return to the "Low" level of the stop detection signal P81 also allows the reset state of the second frequency dividing circuit 63 to be canceled for the restart of its action. Then, after the elapse of about one second after the restart of the counting action of the second frequency dividing circuit 63, the storage timing signal P63 (1/2 Hz) goes from the "Low" level to the "High" level, so that the latch signal P88 is set from the "Low" level to the "High" level.

Then, in response to the rising action of the signal fed to the input terminal CK, the D-FF 89*a* reads the "High" level, and hence the reference stop storage signal P8 goes from the "Low" level to the "High" level. Until this point of time, namely, the timing t5 there appears no storage of a stop of the reference signal generating circuit 6 in the output from the terminal Q of the reference signal stop storing circuit 8.

Then, when the crown is protruded at the timing t6, the reset signal P20 from the manual switching circuit 20 goes from the "Low" level to the "High" level, which signal 20 is applied to the reference signal stop storing circuit 8 to reset the D-FF 89*a*, allowing the reference stop storage signal P8 to return to the "Low" level. That is, the storage of a stop at the timing t6 is canceled. Furthermore, when the crown is retracted at the timing t7, the reset signal P20 goes to the "Low" level, allowing the reference signal stop storing circuit 8 to return its initial state in which a further stop, if any, of the reference signal generating circuit 6 can be detected and stored.

Figure 5:
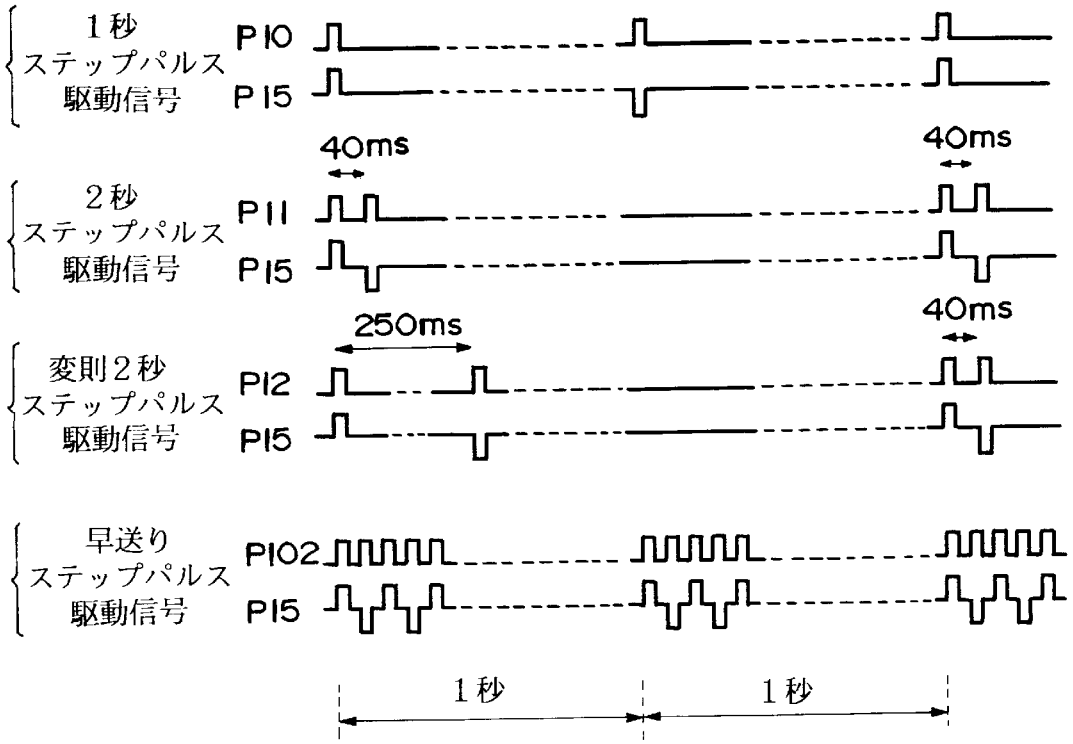
FIG. 5 illustrates waveforms of various drive signals for use in the embodiment.

Referring then to FIG. 5, various signals and corresponding drive signals P15 for use in this embodiment are shown in pairs.

The various signals include the 1 sec. step pulse signal P10 (1 sec. hand driving signal) for allowing an ordinary 1 sec. hand driving, the 2 sec. step pulse P11 (2 sec. step hand driving signal for repeating 40 ms interval step drive pairs every two seconds) which is the charge alarm signal, the irregular 2 sec. step pulse P12 (irregular 2 sec. step hand driving signal for alternating 40 ms interval drive pair and 250 ms interval drive pair every two seconds) which is the stop alarm signal, and the rapid forwarding signal P102 (64 Hz hand driving signal). In order to drive the bipolar pulse motor 17, the corresponding drive signals P15 are in the form of signals whose polarities have alternately been inverted in the motor driving circuit 15.

Figure 6:
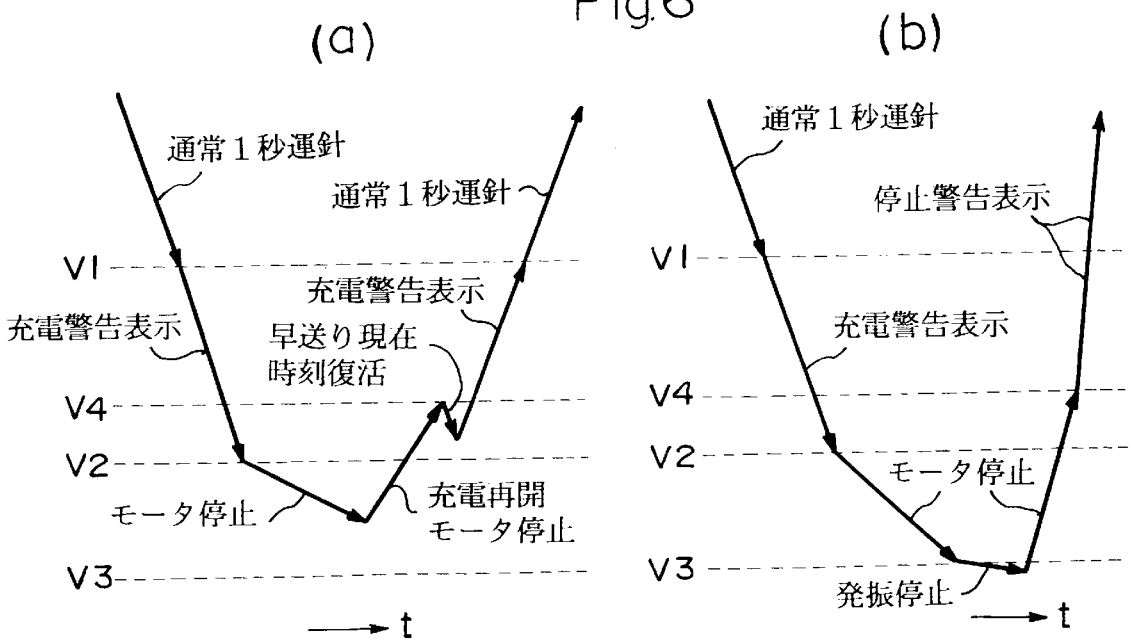
FIGS. 6A and 6B are explanatory diagrams illustrating a difference of variation in the state of a timepiece depending on the magnitude of a voltage drop at a power supply of the embodiment, FIG. 6A showing a case where the dropped voltage has not reached to the voltage V3, with FIG. 6B showing a case where the voltage has dropped below the voltage V3.

FIGS. 6A and 6B are explanatory diagrams each showing collectively the states of action of the timepiece, which can take in the process after the drop of the power-supply voltage. FIG. 6A illustrates a case where the power-supply voltage has dropped below the voltage V2 causing a stop of the motor, without reaching V3 causing a stop of oscillation (a stop of issue of the reference signal). FIG. 6B illustrates a case where the power-supply voltage has further dropped and become lower than the voltage V3.

In the case of FIG. 6A, the ordinary 1 sec. hand driving is carried out until the power-supply voltage goes down to the voltage V1. The charge alarm display is then made until reaching the voltage V2 from below the voltage V1. When the power-supply voltage goes down below the voltage V2, the drive of the motor is stopped (with a stop of the display) and the pulse motor drive stop storing circuit 9 is activated with the current time saved by the counter. The same applies to the state before the power-supply voltage goes up to the voltage V4 after the restart of the charge. When the power-supply voltage rises to reach the voltage V4, a return to the current time display is achieved by the rapid forwarding drive of the motor. In case of an elongated motor stop period of time, a temporary voltage drop may occur as shown due to a power consumption for the rapid forwarding, although the detection level of the voltage V4 has a margin so as to prevent the power-supply voltage from again dropping below the voltage V2 due to the temporary voltage drop. Afterward, the current time is displayed together with the charge alarm display (modulated). When the voltage exceeds V1, a return to the ordinary hand driving is achieved.

In the case of FIG. 6B, the same action as in FIG. 6A is performed until the power-supply voltage goes down to the voltage V2. When the power-supply voltage drops below the voltage V3, the oscillation of the time reference comes to a stop, which is stored by the storing unit 82 of the reference signal stop storing circuit 8. Afterward, the entire circuit goes inoperative with the extinction of the clocks, so that there can be seen little or substantially no power consumption and voltage drop. When the power-supply voltage is restored to the voltage V3 or over, the reference stop storage signal P8 is issued. The signal P8 prohibits the count of the elapsed time and the drive pulses (i.e., provides a control for interrupting the counting action of the elapsed time counter 105), so that no return to the rapid forwarding time is made upon the restoration of the power-supply voltage to the voltage V4 or over. Then, the signal P8 acts on the second selecting circuit 14 so as to allow a selection of the stop alarm signal P12 so that the third selecting circuit also selects the same output therefrom, with the result that an irregular 2 sec. step hand driving display is made. This display state remains unchanged even when the power-supply voltage has been restored to the voltage V1 or over.

Other possible embodiments of the present invention will then be described.

(1) In the above embodiment, separately prepared rapid forwarding restoration control and stop alarm display are provided at the time when the power-supply voltage has dropped and reached the same voltage V4 based on the detection of the V4 detecting circuit 101, in both cases where in the process of a drop of the power-supply voltage arising from a short of charge the motor drive has been prohibited but the circuit oscillation is permitted and where a voltage drop enough to cause a prohibition of the circuit oscillation has occurred. However, different trigger voltages may be employed for the rapid forwarding restoration control and the stop alarm display. For example, the trigger voltage may be different in such a manner that it is the voltage V1 when in the process of a drop of the power-supply voltage the motor drive has been prohibited but the circuit oscillation is permitted and that it is the voltage v4 when a voltage drop enough to cause a prohibition of the circuit oscillation has occurred.

(2) The above embodiment achieves a severe stop detection since it utilizes the induction voltage of the coil to detect a stop of the pulse motor. However, a more simplified configuration may be employed in which when the power-supply voltage has dropped to the voltage V4 or below, an output from the V4 detecting circuit allows a stop of the pulse motor and an action of the pulse motor stop storing circuit. In this case, the pulse motor has some margin of action left, but the circuit is simplified.

(3) The circuit configuration and the drive waveforms are not limited to the above embodiment. For example, the 1 sec. signal, various alarm signals and rapid forwarding signalmay have their respective optimum waveforms (such as intermittent waveforms)

(4) Instead of using the modulated hand driving, the alarm display may be carried out by indicating a mark or the like fixed on the display surface with a pointer for example.

(5) The item display and the alarm display may be provided by a digital display device. In this event, the display need not necessarily be restored by rapid forwarding.

(6) Application may be made to other charging type electronic timepieces using the other type of charging means such as automatic winding electric generation means (including a weight type electric generator) other than the solar batteries as the charging means.

(7) Besides the above, various modifications would be possible including the essential and detailed configurations of the circuit and in respect to the relations with the other features to be provided together.

What is claimed are:

1. A charging type electronic timepiece comprising, an electric storage device for providing a power-supply voltage, which is variable;

power generating means connected to the electric storare device for charging electricity;

reference signal generating means for generating reference signal, time information generating means for generating time information, and a display device for providing a display;

stop alarm signal generating means for generating a signal indicating that a display time is incorrect;

counting means for counting elapsed time during an interruption of display of said display device;

first state detecting means connected to the electric storage device for detecting that the power-supply voltage of said electric storage device has dropped below a predetermined voltage V1 at which the electronic timepiece migrates from a normal use state to a short-of-charging state to reach a predetermined voltage V2 at which a display action of said display device comes substantially to a stop;

second state detecting means for detecting that the power-supply voltage of said electric storage device has dropped below said voltage V2 to reach to a predetermined voltage V3 at which said reference signal generating means becomes substantially inoperative;

display return state detecting means connected to the electric storage device; and priority action selecting means which when said first detecting means has detected that the power-supply voltage of said electric storage device has dropped below said voltage V2, stops the display action of said display device and allows said counter means to start its counting action on a basis of the time information from said time information generating means and, which, in case said second state detecting means had not been detected that the power-supply voltage had not been dropped below said voltage V3 and the display return state detecting means has detected that through a subsequent recharging the power-supply voltage has returned to a voltage which is at least equal to said voltage V2, causes said display device to display a correct time based on the information from said counter means to thereby perform a restoration control action priority over a stop alarm display on the display device, said priority action selecting means providing a stop alarm display on the display device based on a signal from said stop alarm signal generating means priority over said restoration control action in case said second state detecting means had been detected that the power-supply voltage had been dropped below said voltage V3 and when said display return state detecting means has detected that through a subsequent recharging the power-supply voltage has returned to a voltage which is at least equal to said voltage V2.

2. The charging type electronic timepiece according to claim 1, further comprising short-of-charging state detecting means for detecting a state in which said power-supply voltage has reached said voltage V1, and a charging alarm display signal generating device, and wherein when said short-of-charging state detecting means has been detected that said power-supply voltage has dropped below said voltage V1, said display provides a charging alarm display on the display device based on a signal from said charging alarm display signal generating device.

3. The charging type electronic timepiece according to claim 1, wherein said display return state detecting means starts its display return operation at different voltages in a case where a voltage is charged after a power-supply voltage has dropped below said voltage V2 and in a case where a voltage is charged after a power-supply voltage has dropped below said voltage V3.

4. The charging type electronic timepiece according to claim 1, wherein said priority action selecting means is connected to said display device.

5. The charging type electronic timepiece according to claim 2, wherein said priority action selecting means is connected to said display device and controls the display device at said correct time in a form of said charging alarm display.

* * * * *

UNITED STATES PATENT AND TRADEMARK OFFICE

CERTIFICATE OF CORRECTION

PATENT NO. : 6,144,621
DATED : November 7, 2000
INVENTOR(S) : Masahiro Sase

It is certified that error appears in the above-identified patent and that said Letters Patent is hereby corrected as shown below:

Please change Figs. 5, 6A and 6B, as attached herewith.

Fig.5

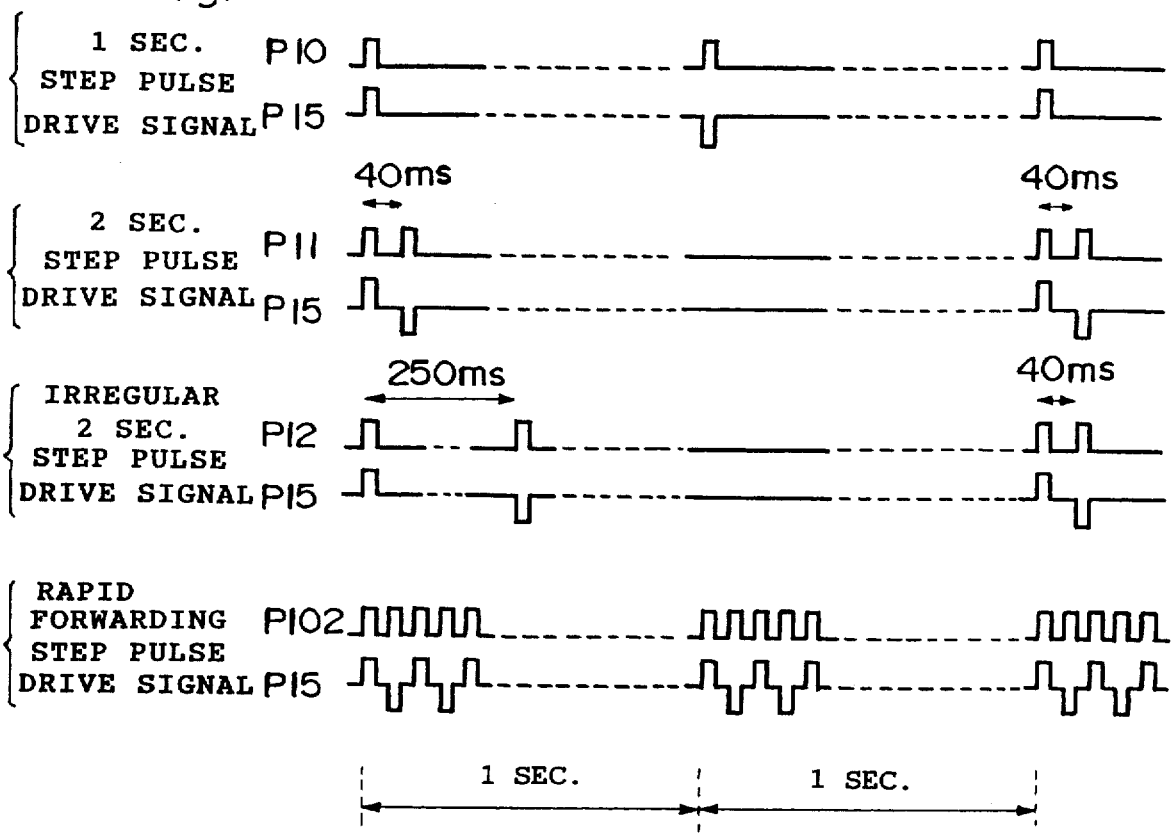

UNITED STATES PATENT AND TRADEMARK OFFICE

CERTIFICATE OF CORRECTION

PATENT NO. : 6,144,621
DATED : November 7, 2000
INVENTOR(S) : Masahiro Sase

It is certified that error appears in the above-identified patent and that said Letters Patent is hereby corrected as shown below:

Fig.6 A

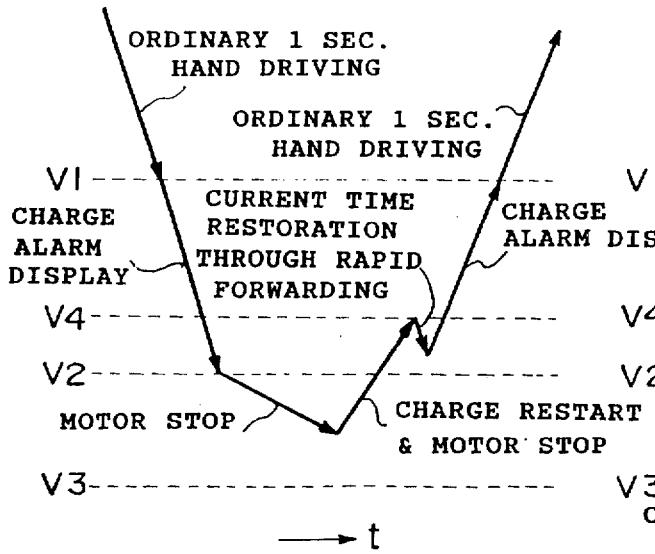

Fig.6 B

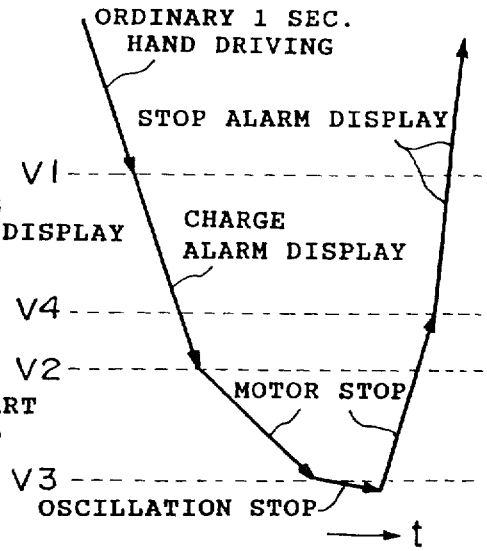

Signed and Sealed this

Eighth Day of May, 2001

*Attest:*

*Attesting Officer*

NICHOLAS P. GODICI

*Acting Director of the United States Patent and Trademark Office*